US007988140B2

(12) United States Patent
Iguchi

(10) Patent No.: US 7,988,140 B2
(45) Date of Patent: Aug. 2, 2011

(54) SHEET STACK LOADER AND SHEET LOADING METHOD

(75) Inventor: Ken Iguchi, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/939,302

(22) Filed: Nov. 4, 2010

(65) Prior Publication Data

US 2011/0052361 A1 Mar. 3, 2011

Related U.S. Application Data

(62) Division of application No. 11/859,919, filed on Sep. 24, 2007, now abandoned.

(60) Provisional application No. 60/863,035, filed on Oct. 26, 2006.

(30) Foreign Application Priority Data

Mar. 23, 2007 (JP) ..... 2007-076799

(51) Int. Cl.
*B65H 29/00* (2006.01)

(52) U.S. Cl. ..... 270/58.28; 270/58.13; 270/58.14; 270/58.15; 270/58.19

(58) Field of Classification Search ..... 270/37, 270/58.13, 58.14, 58.15, 58.19, 58.28; 271/177, 271/180, 212
See application file for complete search history.

(56) References Cited

U.S. PATENT DOCUMENTS

| | | | | |
|---|---|---|---|---|
| 3,568,860 | A | 3/1971 | Rawlins | |
| 5,667,213 | A | 9/1997 | Chida et al. | |
| 6,805,346 | B2 * | 10/2004 | Stemmle | 271/178 |
| 2004/0217534 | A1 | 11/2004 | Bohn | |

FOREIGN PATENT DOCUMENTS

| | | |
|---|---|---|
| JP | 02-231358 | 9/1990 |
| JP | 03-036148 | 2/1991 |
| JP | 2002-104712 | 4/2002 |

OTHER PUBLICATIONS

U.S. Office Action dated Jul. 15, 2010 corresponding to U.S. Appl. No. 11/859,919.
U.S. Office Action dated Apr. 7, 2010 corresponding to U.S. Appl. No. 11/859,919.

* cited by examiner

*Primary Examiner* — Leslie A Nicholson, III
(74) *Attorney, Agent, or Firm* — Turocy & Watson, LLP

(57) ABSTRACT

A sheet stack loader includes a loading table to support a first folded sheet bundle, an elevator to lift the first folded sheet bundle from the loading table, and a conveyer to convey a second folded sheet bundle into a space between the loading table and the first folded sheet bundle, wherein the space is created by the elevator.

2 Claims, 8 Drawing Sheets

SHEET STACK LOADER AND SHEET LOADING METHOD

CROSS-REFERENCE TO RELATED APPLICATION

This application is a Division of application Ser. No. 11/859,919 filed Sep. 24, 2007, which is based upon and claims the benefit of priority from the U.S. Patent Provisional Application No. 60/863,035 filed on Oct. 26, 2006 and Japanese Patent Application No. 2007-076799 filed on Mar. 23, 2007, the entire contents of all of which are incorporated herein by reference.

BACKGROUND

1. Field of the Invention

The present invention relates to a sheet stack loader and a sheet loading method used in a sheet post-processing apparatus installed on the later stage of a copying machine or others.

2. Description of the Related Art

Various sheet post-processing apparatuses for performing a process of folding a sheet bundle formed by stitching, making a hole in, and saddle-stitching image-formed sheets by an image forming apparatus such as a copying machine, a printer, or a facsimile are proposed. Generally, there is a sheet post-processing apparatus available having, for example, two ordinary sheet receiving trays for loading ordinary sheets, stitched sheet bundles, and sorted sheet bundles on the upper part of the side of the housing and furthermore separately having an exclusive folded sheet receiving tray for loading folded sheets obtained by saddle-stitching a plurality of sheets at the center using a stapler and furthermore folding them at the center using folding rollers and a folding plate.

In the sheet post-processing apparatus having the two kinds of receiving trays aforementioned, the folded sheet receiving tray is installed under the ordinary sheet receiving tray. Therefore, the folded sheet loading method uses a system to transport folded sheets through the transport port from the folding and stitching side thereof and sequentially load them straight on the top of the folded sheets loaded already.

However, by this method, when many folded sheets are loaded and the height of folded sheets reaches close to the transport port, a jam of rushing of folded sheets transported later into the folded sheets loaded already from the side not folded and stitched is caused, thus normal transporting and loading of folded sheets are obstructed. To avoid it, it is necessary to restrict the loading quantity or to install the transport port of folded sheets at a higher position. However, if there is an excessive difference of elevation between the transport port and the receiving tray, loading of folded sheets becomes unstable. Or, the vertical driving range of the ordinary sheet receiving tray is restricted, thus it results in restriction on the loading quantity of the ordinary sheet receiving tray.

For this problem, as disclosed in Japanese Patent Application Publication No. 2002-104712, a sheet post-processing apparatus with no exclusive folded sheet receiving tray installed to share the ordinary sheet receiving tray and folded sheet receiving tray is proposed. This post-processing apparatus has two upper and lower ordinary sheet receiving trays driving on the side of the housing of the apparatus, and the folded sheet transport port is installed immediately under the ordinary sheet transport port, thus the trays can be shared.

However, in the conventional sheet post-processing apparatus, to install the folded sheet transport port immediately under the ordinary sheet transport port, the conveying path in the apparatus must be made longer, resulting in an increase in cost. Further, the receiving trays are shared, so that under the condition that ordinary print and folding print are job-reserved alternately, the receiving trays are moved to the respective transport ports, and then the sheets are transported, so that the switching time is required inefficiently. Furthermore, under the condition that the reservation is continued such as ordinary printing, taking a plurality of copies using the sorting process, and taking a plurality of printings by the folding process, in the receiving trays, folded sheets and ordinary sheets are overlaid, and the loading balance gets worse or for example, when intended to transport sheets using the sorting process to the ordinary sheet receiving tray, sheets ordinarily printed and sheets using the sorting process are mixed on the receiving tray and the sorting process requires much labor and time.

SUMMARY

The present invention is intended to provide a sheet stack loader and a sheet loading method capable of loading more folded sheets without causing a jam and improving the transport efficiency of the post, processing of various prints.

According to the embodiments of the present invention, a sheet stack loader is provided and the sheet stack loader comprises a loading table for supporting a first folded sheet bundle, an elevator for lifting the first folded sheet bundle from the loading table, and a conveyer for conveying a second folded sheet bundle into a space between the loading table and the first folded sheet bundle, wherein the space is created by the elevator.

Further, according to the embodiments of the present invention, a sheet loading method is provided and the sheet loading method comprises the steps of supporting a first folded sheet bundle on a loading table, lifting the first folded sheet bundle from the loading table and forming a space between the first folded sheet bundle and the loading table, and conveying a second folded sheet bundle into the space.

DETAILED DESCRIPTION OF THE EMBODIMENTS

Hereinafter, the embodiments of the present invention will be explained with reference to the accompanying drawings.

Figure 1:
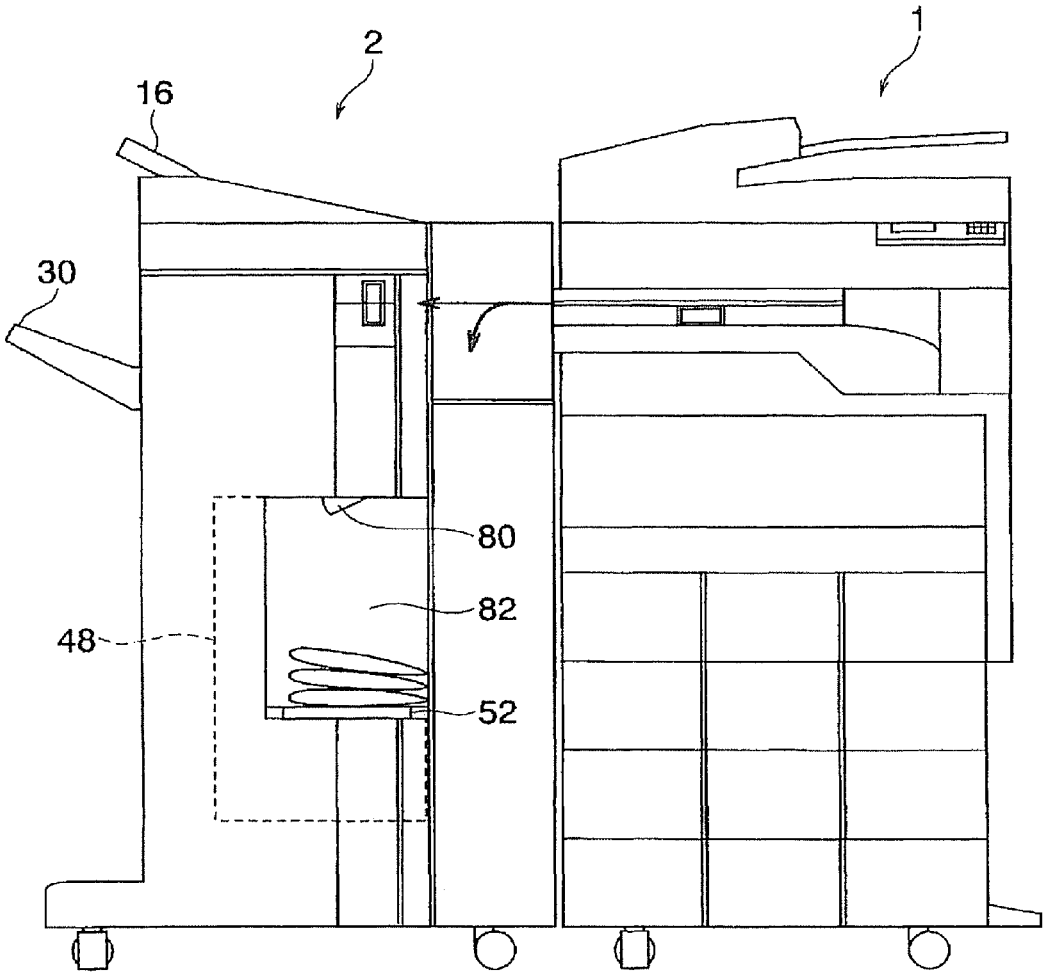
FIG. 1 is a schematic view of the copying machine having the sheet stack loader of the embodiments relating to the present invention.
Figure 2:
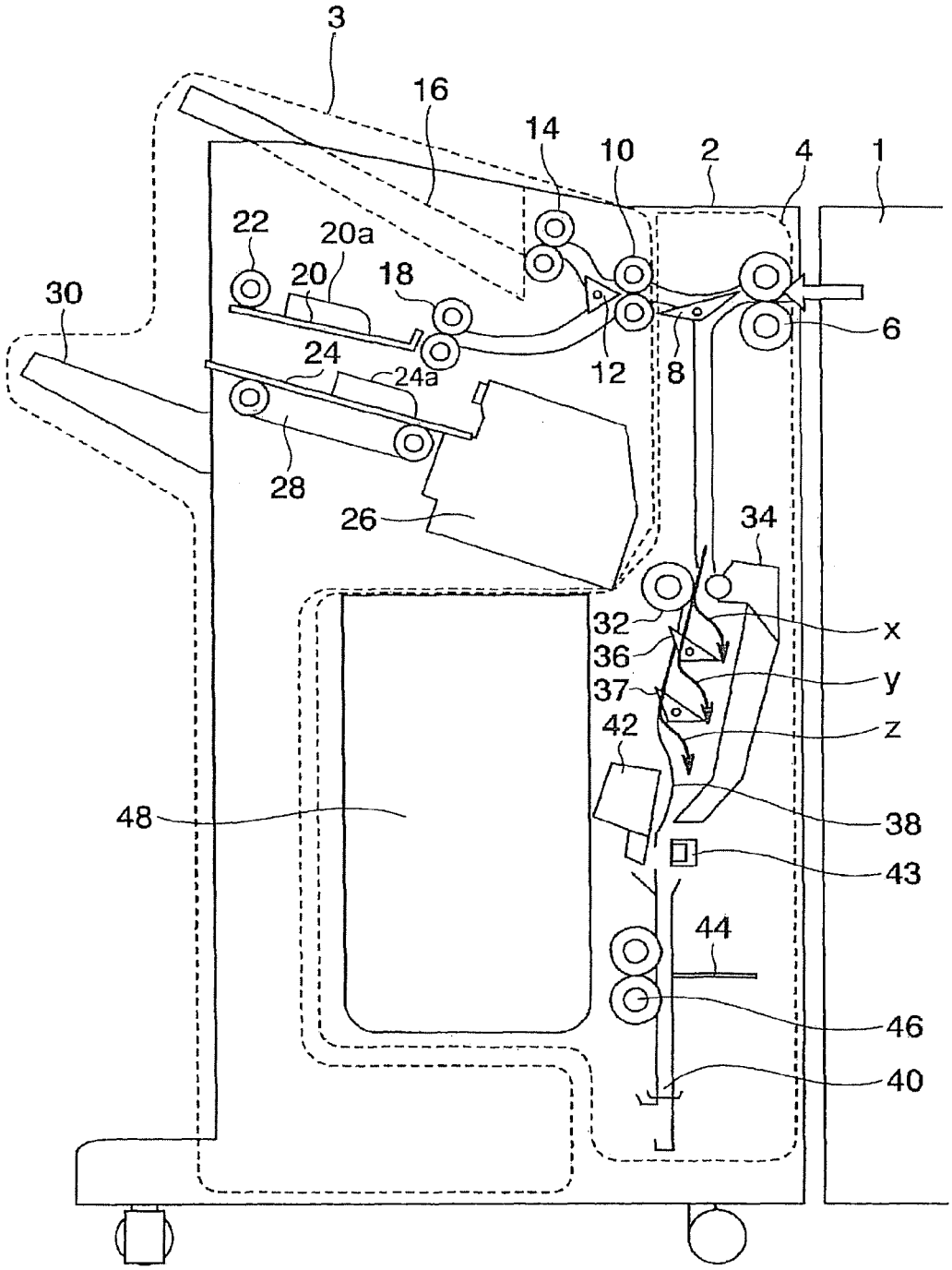
FIG. 2 is a schematic view showing the schematic constitution of the sheet stack loader.

FIG. 1 is a schematic view of the copying machine having the sheet stack loader of the embodiments relating to the present invention and FIG. 2 is a schematic view showing the constitution of the sheet stack loader of the embodiments relating to the present invention. Hereinafter, by referring to FIGS. 1 and 2, the constitution and operation of each component will be explained.

As shown in FIGS. 1 and 2, a sheet stack loader 2 is connected to a copying machine 1 and sheets conveyed from the copying machine 1 are folded and saddle-stitched and then are loaded on an elevating portion 52 of a sheet bundle stacker 48. The sheet stack loader 2 has an opening 82 which is a takeout port to take out folded sheets loaded on the side of the housing of the sheet bundle stacker 48.

The sheet stack loader 2 post-processes sheets transported from the copying machine 1 according an input instruction from the operation panel of the copying machine 1 and a print instruction from a personal computer. The sheet stack loader 2 has a finisher portion 3 to perform the post processes other than the folding process and saddle stitching process, for example, the ordinary printing process, sorting process, and stitching process of the end of folded sheets and a saddle portion 4 to perform the folding process and saddle stitching process.

The finisher portion 3 includes a second branching member 12 to switch the conveying path according to the sheet printing process, a first receiving tray 16 to load ordinary print sheets, a handling tray 24 to load folded sheets to be stitched, a stapler 26 to perform the stitching process of folded sheets, a queuing tray 20 to collect sheets conveyed temporarily to reserve the time required for the stitching process and transport of sheets, and a second receiving tray 30 to load folded sheets which are stitched and sorted.

The saddle portion 4 includes a second handling tray 34 arranged almost perpendicularly and a first sheet branching plate 36 and a second sheet branching plate 37 to decide the sheet conveying path according to the sheet size. Furthermore, the saddle portion 4 includes a sheet positioning plate 40 drivable to decide the sheet position so as to make the saddle stitching position and folding position coincide with the sheet center and two saddle stitch staplers 42 to saddle-stitch the central part of sheets. Furthermore, the saddle portion 4 includes a sheet folding plate 44 for pressing the center of folded sheets and transporting them toward sheet folding rollers 46, sheet folding rollers 46 to hold and fold the sheets pressed and transported by the sheet folding plate 44, and a sheet bundle stacker 48 installed in the sheet stack loader 2 to stock folded sheets.

In the sheet stack loader 2, sheets ejected from the copying machine 1 are transported into the sheet stack loader 2 by entrance rollers 6.

In the ordinary printing free of special post processing, sheets, after the conveying path is branched by a first branching member 8, are conveyed to a first conveying roller 10 installed in the finisher portion 3. Then, the sheets branched by the second branching member 12 and conveyed toward a carrying out roller 14 are ejected to and loaded on the first receiving tray 16 by the carrying out roller 14.

When performing the stitching process of the end of folded sheets and the sorting process when taking a plurality of printings without performing the folding process and saddle stitching process, the sheets, after the conveying path is branched firstly by the first branching member 8, are conveyed to the first conveying roller 10 installed in the finisher portion 3. Then, the sheets branched by the second branching member 12 and conveyed toward second conveying rollers 18 are sent to the queuing tray 20 by the second conveying rollers 18.

The queuing tray 20 is composed of a pair of queuing tray components 20*a* which can move right and left and receives sheets when the queuing tray components 20*a* are closed. The queuing tray 20 adjusts the flow of sheets by storing temporarily a predetermined number of sheets conveyed sequentially and reserves the time required for transport of sheets and stitching of the end of folded sheets carried out on the downstream side of the sheet conveying path which will be described later. By doing this, sheet loading is carried out smoothly. Further, a queuing tray roller 22 aligns sheets stored on the queuing tray 20.

When the predetermined number of sheets are stored on the queuing tray 20, the queuing tray components 20*a* are opened and the folded sheets fall on the handling tray 24 by the own weight. The sheets sent to the handling tray 24 are aligned lengthwise and crosswise by aligning members 24*a*.

When stitching folded sheets, if the predetermined number of sheets are aligned and stored on the handling tray 24, they are stitched by the stapler 26. The folded sheets stitched by the stapler 26 are transported to and loaded on the second receiving tray 30.

When performing only the sorting process, the sheets sent to and aligned by the handling tray 24 are not stitched by the stapler 26 and are transported to and loaded on the second receiving tray 30 by a conveying structure 28.

On the other hand, when performing the folding process and saddle stitching process, sheets conveyed into the sheet stack loader 2 by the entrance rollers 6, after the conveying path is branched firstly by the first branching member 8, are conveyed to a third conveying roller 32 installed in the saddle portion 4. Furthermore, for the sheets, according to the sheet size, the sheet conveying route is decided by the first sheet branching plate 36, second sheet branching plate 37, and a guide member 38. For example, when the sheet size is A3, the sheets are sent through the conveying route of an arrow x this side of the first sheet branching plate 36 and are stored almost vertically by the sheet positioning plate 40 and second handling tray 34. When the sheet size is B4, the sheets are sent through the space between the first sheet branching plate 36 and the guide member 38 and through the conveying route of an arrow y this side of the second sheet branching plate 37 and are stored almost vertically by the sheet positioning plate 40 and second handling tray 34. When the sheet size is A4, the sheets are sent through the conveying route of an arrow z along the guide member 38 and are stored almost vertically by the sheet positioning plate 40 and second handling tray 34.

When the predetermined number of sheets are stored on the second handling tray 34, the central part of the sheets is moved to the stitching position of the saddle stitch stapler 42 by the sheet positioning plate 40 and by the two saddle stitch staplers 42 arranged on this side and the innermost side of the drawing and an anvil 43, the folded sheets are subject to the stitching process at the two locations of the central part.

The sheet bundle subject to the stitching process is arranged so as to move the central position thereof to the position of the sheet folding plate 44. After completion of the arrangement, the center (the stitching position) of the sheet bundle is pushed toward the sheet folding plate 44 by the sheet folding plate 44, and the sheet folding rollers 46 nip and convey the sheet bundle by pressurizing, thus the sheet bundle is folded and is transported to the sheet bundle stacker 48. Further, when only one sheet is conveyed from the copying machine 1, the stitching process by the stapler 42 is not performed and the aforementioned folding process is performed.

Figure 3:
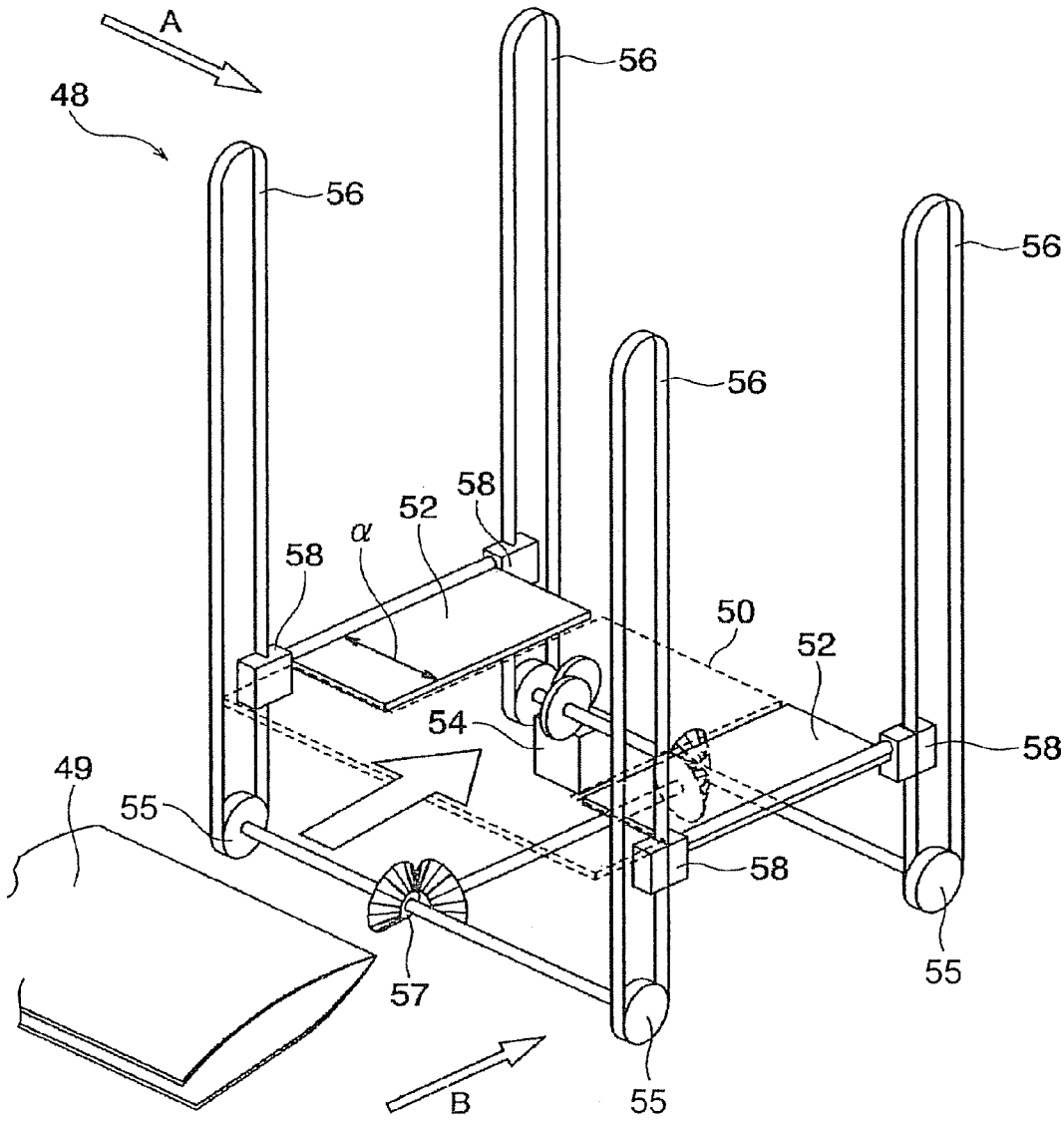
FIG. 3 is a perspective view showing schematically the folded sheet bundle stacker of the sheet stack loader.

FIG. 3 is a perspective view showing schematically the sheet bundle stacker 48 of the sheet stack loader relating to the embodiments. Further, in FIG. 3, to make the drive mechanism understandable, the loading table 50 is drawn by a dashed line.

As shown in FIG. 3, the sheet bundle stacker 48 includes the loading table 50 to load a folded sheet bundle 49 transported from the sheet folding rollers 46, the two elevating portions 52 to lift the sheet bundle, and a drive mechanism to drive the elevating portions 52. The loading table 50 is fixed to the housing of the sheet stack loader 2. The method to load the sheet bundle 49 on the sheet bundle stacker 48 will be described later.

The drive mechanism is composed of a motor 54, pulleys 55, driving belts 56, and gears 57. By the motor 54 installed under the loading table 50, the four driving belts 56 move linking with each other and move up and down the elevating portions (elevating means) 52 attached to the driving belts 56 by fasteners 58. The elevating portions 52 can move to the lower position, for example, at a distance of a width ∂ of the elevating portions 52 or more from the position of the loading table 50 and can move upward up to a height at least equal to the thickness of the transported sheet bundle 49 or more from the position of the loading table 50.

Figure 4A:
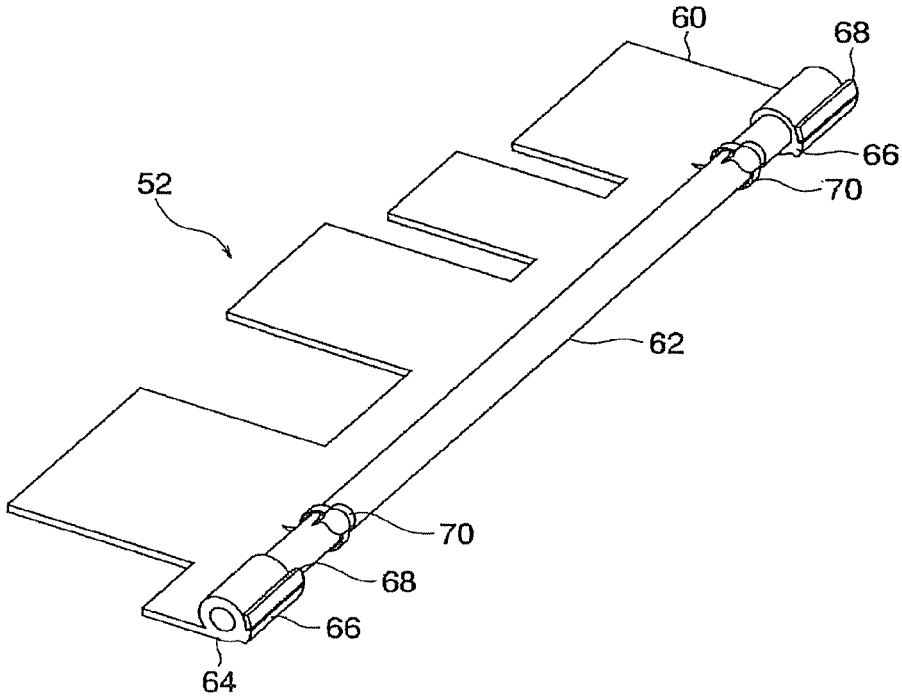
FIG. 4 is a detailed perspective view of the sheet elevating member composing the folded sheet bundle stacker.
Figure 4B:
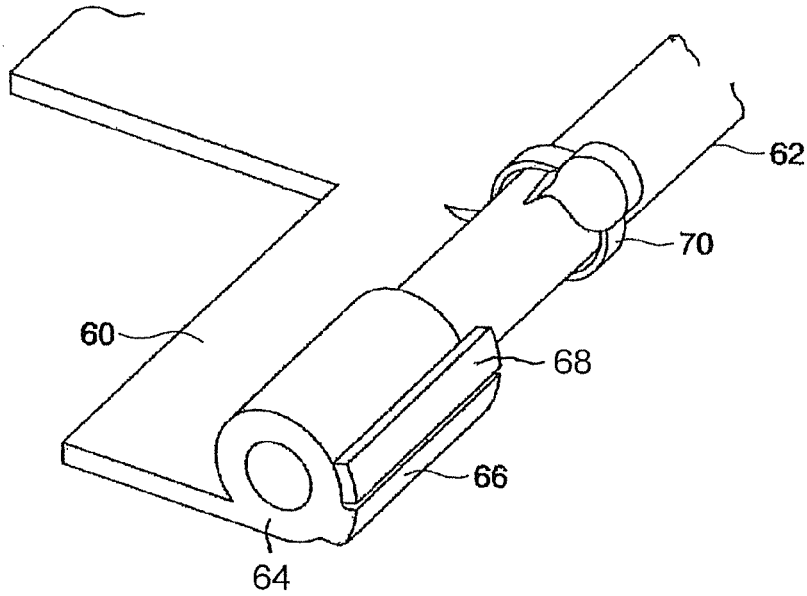

Next, the elevating portion 52 will be explained by referring to FIGS. 4 and 5. FIG. 4 is a detailed perspective view showing the elevating portion.

The elevating portion 52 includes an elevating member 60, a shaft 62, rotating portions 64, and springs 70. The elevating member 60 has the rotating portions 64 at both ends thereof and is attached rotatably to the shaft 62 by the rotating portions 64.

Further, the elevating member 60, by joint of salients 66 installed on the rotating portions 64 and stoppers 68 installed on the shaft 62, is structured so as not to incline below the horizontal state. Namely, the elevating member 60 is structured, when force is applied from underneath, so as to rotate upward from the horizontal direction round the shaft 62, though even if a load is applied from above in the horizontal state, so as not to rotate downward. The salients 66 and stoppers 68 compose a control means to control so as not to incline downward from the horizontal state.

The shaft 62 is attached with springs 70 such as winding springs and when by the action of the springs 70, the force applied to the elevating member 60 from underneath becomes smaller than the elastic load of the springs 70, the elevating member 60 rotated upward is returned to the horizontal position. The springs 70 compose a posture control means to return the elevating member 60 to the horizontal state.

Further, the upward rotation limit angle of the elevating member 60 can be adjusted by the installation positions of the stoppers 68 and salients 66.

Figure 5A:
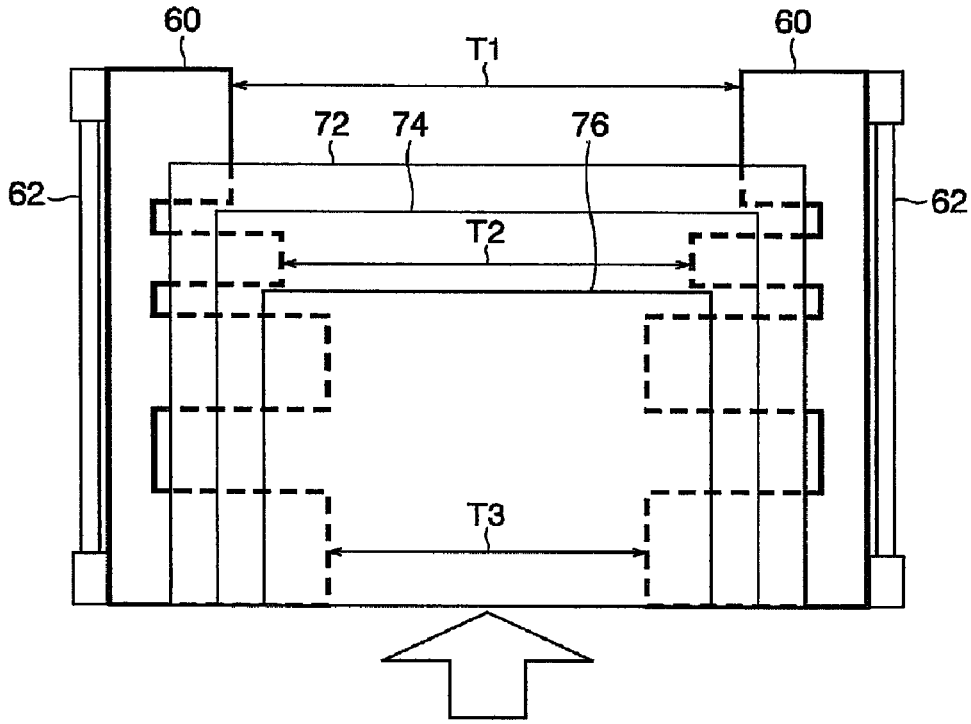
FIG. 5 is a schematic view to explain the structure of the sheet elevating member.
Figure 5B:
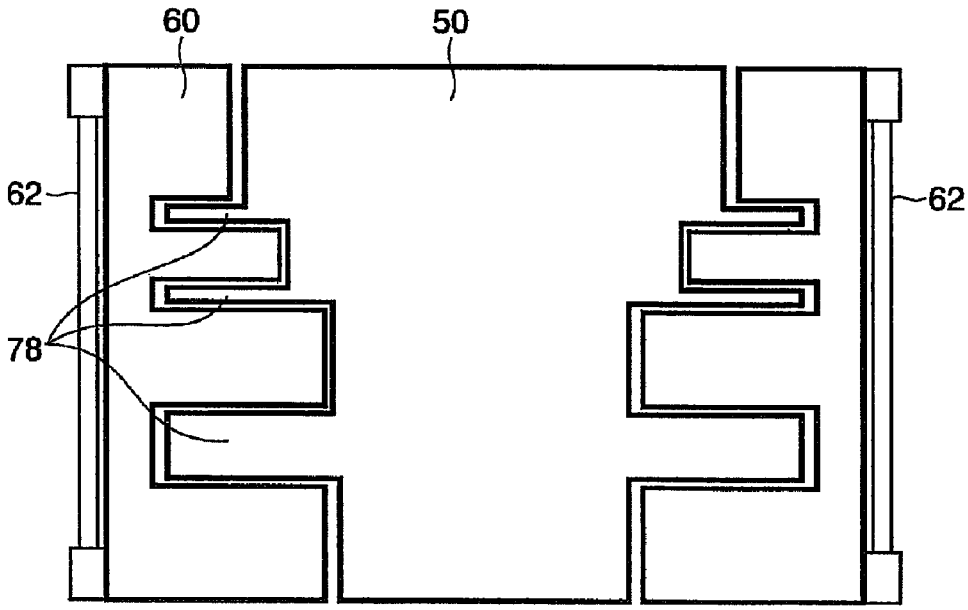

FIGS. 5A and 5B are plan views to schematically show the shape of the elevating member 60. FIG. 5A is a drawing showing A3 sized folded sheets 72, B4 sized folded sheets 74, and A4 sized folded sheets 76 which are loaded on the elevating member 60, wherein the loading table 50 is not drawn. FIG. 5B shows the shapes of the elevating member 60 and loading table 50.

As shown in FIG. 5A, the elevating members 60 are arranged opposite to each other on both sides of the loading table 50. The opposite sides of the elevating members 60 are formed in a comb structure. Further, the elevating members 60, to elevate the folded sheets different in size, for example, respectively the A3 sized folded sheets 72, B4 sized folded sheets 74, and A4 sized folded sheets 76, the lengths of the teeth of the combs of the elevating members 60 are made different from each other and the distance between the elevating members 60 is made different according to the folded sheets. Namely, the length of the outermost tooth is made shortest, thus a distance T1 between the opposite teeth is made slightly shorter than the width of the A3 sized folded sheets, and the length of the second tooth from the outside is made second shortest, thus a distance T2 between the opposite teeth is made slightly shorter than the width of the B4 sized folded sheets, and next the length of the third tooth from the outside is made third shortest, thus a distance T3 between the opposite teeth is set slightly shorter than the width of the A4 sized folded sheets.

On the other hand, as shown in FIG. 5B, both sides of the loading table 50 are formed as a comb structure so as to mesh with the comb-shaped portions of the elevating members 60. By the teeth of the combs of the loading table 50, for example, even if the transport direction of the folded sheets is shifted, the folded sheets can be prevented from falling from the loading table 50. Further, the length of the teeth of the combs of the elevating member 60, as shown in the drawing, is fit to the size of each sheet and additionally, the lengths of all the teeth are made longer in correspondence to, for example, the A4 sized sheets with the shortest width, thereby may be unified to the distance T3 between the opposite teeth.

Figure 6B:
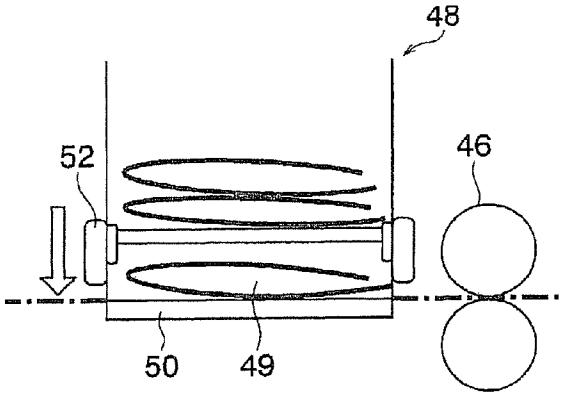
FIG. 6 is a schematic view to explain the operation of the folded sheet bundle stacker.
Figure 6A:
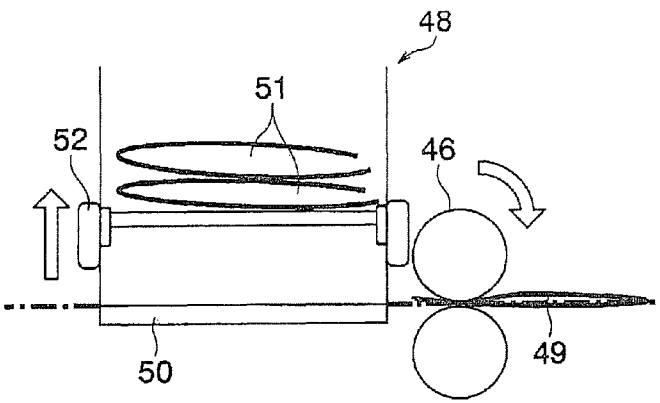
Figure 6E:
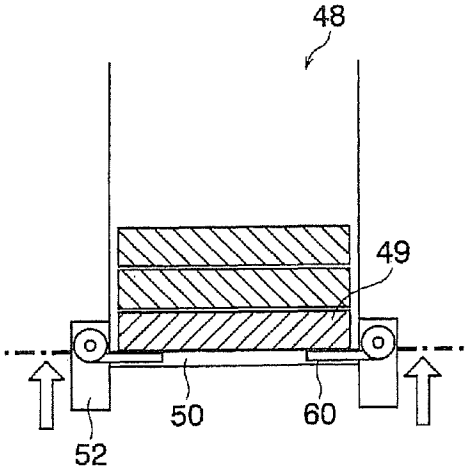

Next, the operation of the sheet bundle stacker 48 will be explained by referring to FIGS. 6 and 7. FIG. 6 is a schematic view to explain the operation of the sheet bundle stacker 48, and FIGS. 6A and 6B are drawings viewed in the direction of an arrow A shown in FIG. 2, and FIGS. 6C, 6D and 6E are drawings viewed in the direction of an arrow B shown in FIG. 2. FIG. 7 is a flow chart to explain the operation of the sheet bundle stacker 48.

Firstly, as shown in FIG. 6A, when the loading is started, the elevating portion 52 standing by at the same position as that of the loading table 5 moves up, lifts up loaded folded sheets 51 which are folded already and are loaded on the loading table 50, thus between the loading table 50 and the elevating portion 52, a space capable of transporting the folded sheet 49 is formed (Step S1). A new folded sheet 49 is sent onto the loading table 50 by the sheet folding rollers 46 (Step S2). Here, the folded sheets 51 are loaded already on the elevating portion 52, though even when the folded sheet 49 is not loaded, the start operation is the same.

As shown in FIG. 6B, when the folded sheet 49 is transported onto the loading table 50, the elevating portion 52 starts to move down (Step S3). Next, as shown in FIG. 6C, when the elevating portion 52 moves down and the bottom of the elevating member 60 makes contact with the folded sheet 49 (Yes at Step S4), in correspondence with the descent of the elevating portion 52, the elevating member 60 is rotated so as to be pushed up (Step S5). Further, when the bottom of the elevating member 60 is not in contact with the folded sheet 49 (No at Step S4), the elevating member 60 moves down continuously (Step S3).

Figure 6D:
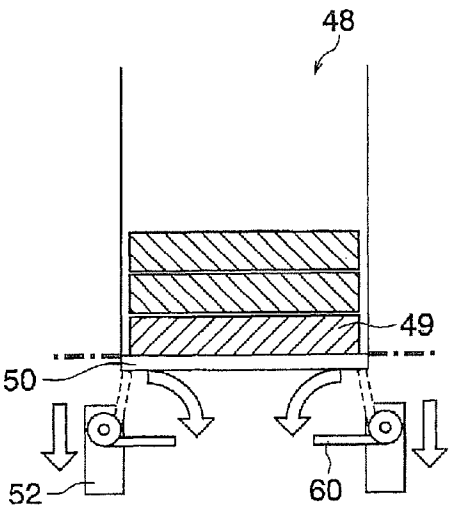
Figure 6C:
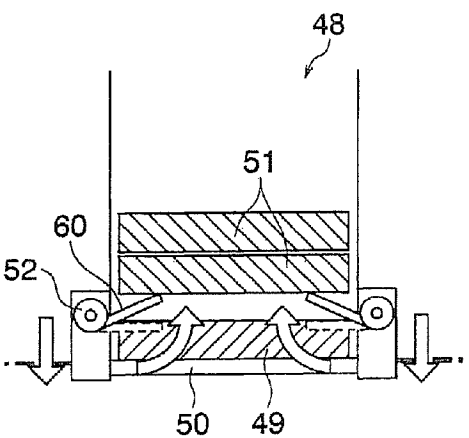
Figure 7:
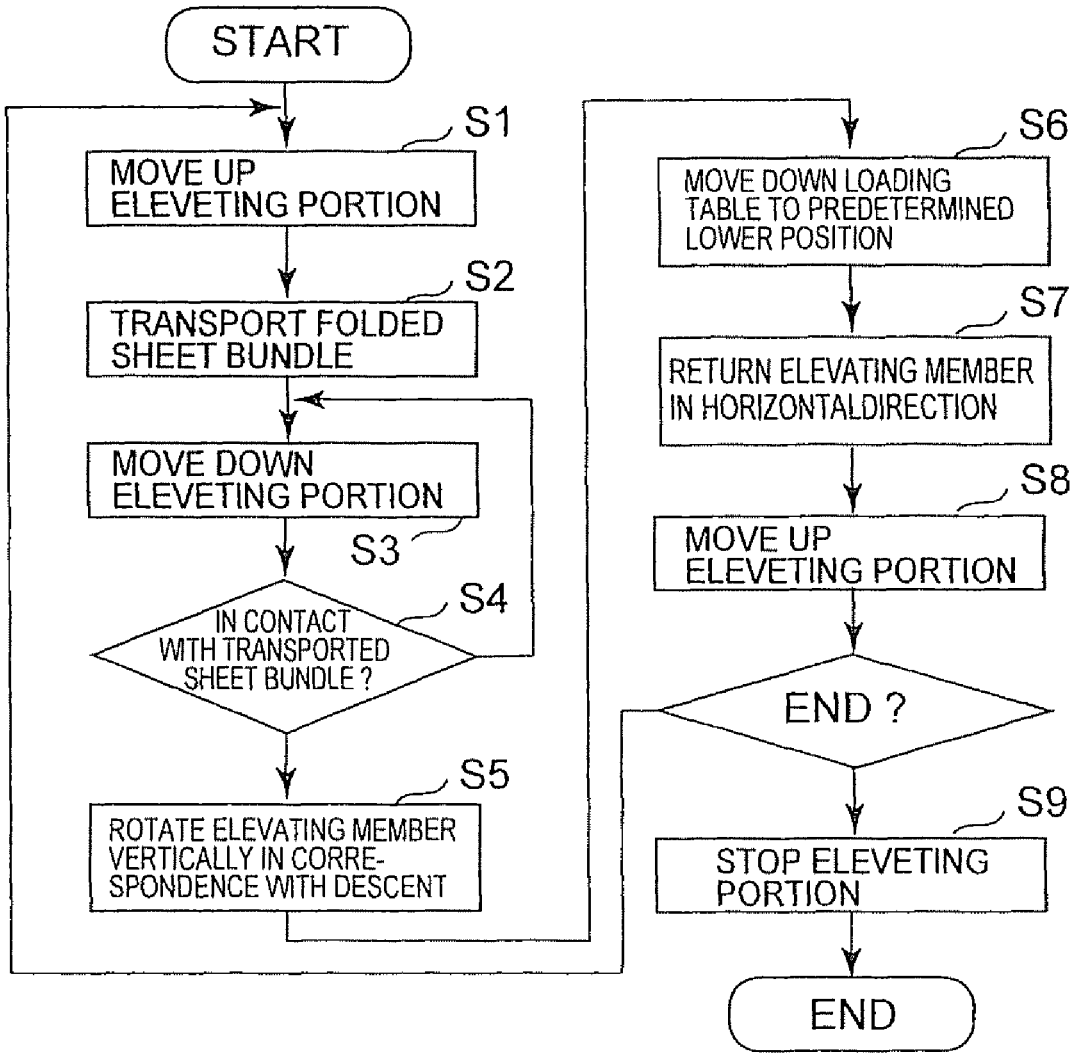
FIG. 7 is a flow chart to explain the operation of the folded sheet bundle stacker.

As shown in FIG. 6D, the elevating portion 52 continuously moves down straight and when the end of the rotating elevating member 60 reaches the top of the folded sheet 49 as shown by the dashed line, the folded sheets 51 fall on the top of the folded sheet 49 and are loaded. Therefore, the folded sheets 51 are loaded after approaching close to the folded sheet 49, so that can be loaded stably.

Then, when the elevating portion 52 moves down to a predetermined position, for example, the position below by the length of the teeth of the comb of the elevating member 60 from the bottom of the folded sheet 49 (the position where the end of each tooth of the rotating elevating member 60 passes the bottom of the folded sheet 49) (Step S6), the elevating member 60 is returned to the horizontal state by the spring 70 (Step S7). In this state, all the folded sheets are loaded on the loading table 50. Next, as shown in FIG. 6E, the elevating portion 52 moves up to the position of the loading table 50 (Step S8).

Furthermore, when continuing the loading process and transporting the folded sheet 49, the elevating portion 52 moves up, lifts the folded sheet 49 loaded already, thereby forms a space to receive the succeeding folded sheet 49 between the loading table 50 and the elevating portion 52. Hereinafter, this operation is repeated and when the printing and loading are finished, the elevating portion 52 is stopped at the position of the loading table 50 (Step S9). Or, when the space to transport folded sheets is formed, the elevating portion 52 may be stopped.

Further, when the folded sheets 51 are increased and the elevating portion 52 moves up to form the space to transport the succeeding folded sheet 49, even if the uppermost folded sheet of the folded sheets 51 makes contact with the top of the sheet bundle stacker 48, generally, since the folded sheet 49 is bulging, when the loaded folded sheets 51 is compressed by the elevating portion 52 and the upper part of the sheet bundle stacker 48, the loading space can be reserved. With respect to loading after contact, a sensor to detect loading limit 80 having an electric switch installed on the upper part of the sheet bundle stacker 48 shown in FIG. 1 is used, and when it is detected by the sensor to detect loading limit 80 that the loaded folded sheets 51 makes contact with the sensor to detect loading limit 80, on the basis of preset setting information on the number of sheets to be loaded additionally after contact with the loaded folded sheets 51, the loading is continued. The setting information on the number of sheets to be loaded additionally after contact of the loaded folded sheets 51 with the sensor to detect loading limit 80 can be set, if the connection device 1 to convey sheets is, for example, a copying machine, from a personal computer connected by the operation panel of the copying machine or a network.

In the flow aforementioned, at time of start or stop of a series of operations, the standby position of the elevating portion 52 is defined as the same position as that of the loading table 50, though the present invention is not limited to it, and when the elevating portion 52 is stopped, assuming the elevating portion 52 always to stand by above the loading table 50 in the state that the space to transport folded sheets is formed, the predetermined operations may be repeated.

In the sheet stack loader of this embodiment aforementioned, unlike the method to load from the uppermost sheet such as the conventional loading method, in the folded sheet bundle stacker 48, the folded sheets 51 transported already are lifted by the elevating portion 52, thus the transport space for the succeeding folded sheet 49 is reserved, and the succeeding folded sheet 49 is transported to the transport space, so that there is no fear that a jam of rushing of the succeeding folded sheet 49 into the folded sheets 51 may occur. Further, the folded sheets 51 lifted by the elevating portion 52 approach the folded sheet 49 transported to the loading table 50 and then are loaded, thereby can be loaded stably.

Further, compared with the case that the folded sheet receiving tray is installed as usual on the lowest part of the sheet stack loader, the loading portion can be reserved wide in the sheet stack loader, so that the loading amount of folded sheets is increased. Furthermore, many folded sheets 51 loaded on the elevating portion 52 are compressed by the elevating portion 52 and the top end of the sheet bundle stacker 48, thus the loading space can be reserved, so that more folded sheets can be loaded.

Further, separately from the first receiving tray 16 for general printing and the second receiving tray to load folded sheets which are stitched and sorted, the exclusive sheet bundle stacker 48 is installed, so that there is no need to move the receiving trays to the respective transport ports like the conventional sheet stack loader. Therefore, the switching time is not required and the efficiency is satisfactory.

MODIFICATION OF THE EMBODIMENTS

Figure 8:
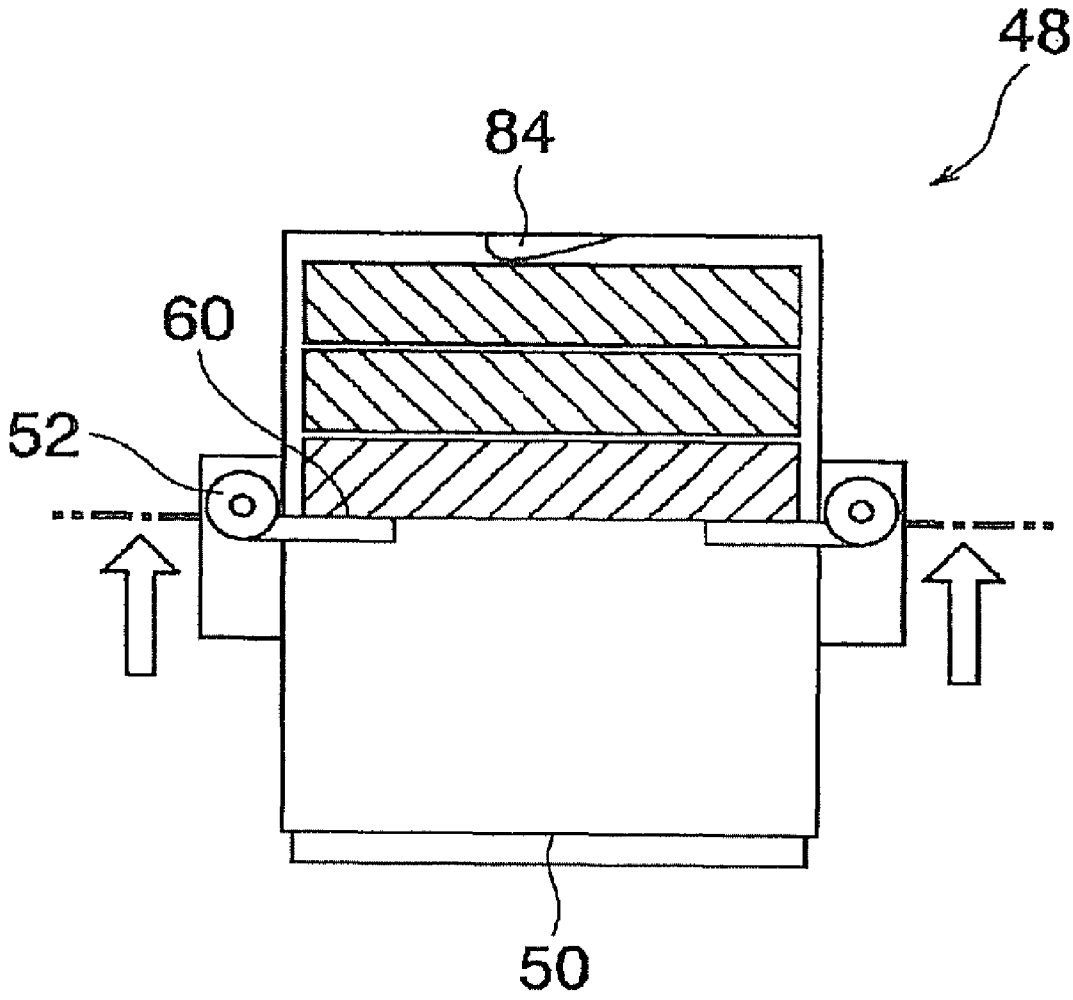
FIG. 8 is a schematic view to explain a modification of the embodiments of the present invention.

FIG. 8 is a schematic view to explain a modification of the sheet elevating portion of the embodiments. Here, a modification of the operation after printing will be explained.

As shown in FIG. 8, in the sheet stack loader 2 of this modification, at the top end of the sheet bundle stacker 48, a height sensor 84 is installed. As a height sensor 84, for example, an optical sensor or a simple electric switch is used. The other structure is the same as that of the embodiment aforementioned.

At the end time of loading, the folded sheet elevating portion 52 of the embodiment aforementioned is defined to stop at the same position as that of the loading table 50 or to stop above the loading table 50 in the state that the space to transport folded sheets is formed. However, in the modification of this embodiment, at the end time of loading, the elevating portion 52 is moved up until the top of the folded sheets loaded on the elevating portion 52 is detected by the height sensor 84 and when the height sensor 84 detects the top of the folded sheets, the elevating portion 52 is stopped.

According to the modification aforementioned, compared with the case that at the end of loading, the elevating portion 52 is just stopped in the neighborhood of the loading table 50, the folded sheets are moved to a higher position, so that the folded sheets can taken out in an almost ordinary posture and compared with the sheet stack loader of the embodiment aforementioned, the folded sheets take-out operation can be performed efficiently.

Further, the present invention is not limited to the embodiments and modification aforementioned and within a range which is not deviated from the objects thereof, may be modified variously and executed and the embodiments aforementioned may be combined properly and executed.

What is claimed is:

1. A sheet stack loader comprising:

a loading table to support a first folded sheet bundle;

an elevator to lift the first folded sheet bundle from the loading table to form a space between the loading table and the first folded sheet bundle;

the elevator further comprising:

a motor;

a shaft attached to the motor;

an elevating member attached to the shaft rotatably to lift the first folded sheet bundle onto the loading table;

a stopper provided at a connection portion of the shaft and the elevating member to restrict a rotation range of the elevating member, resulting in the elevating member not being inclined from the horizontal direction by the stopper; and a spring attached to the shaft so as to return the elevating member to its original horizontal state when the elevating member is rotated upwardly; and a conveyer to convey a second folded sheet bundle into the space.

2. The sheet stack loader according to claim 1, the elevating member and the loading table having respectively a comb shape so as to make opposite sides thereof mesh with each other.

* * * * *